US007955125B1

(12) United States Patent
Petrillo et al.

(10) Patent No.: US 7,955,125 B1
(45) Date of Patent: Jun. 7, 2011

(54) ELECTRICAL CONNECTOR WITH ONE END THREADABLY CONNECTED TO A JUNCTION BOX AND OTHER END CONFIGURED TO BE CONNECTED TO A MATING ELECTRICAL CONNECTOR

(75) Inventors: Nicholas P. Petrillo, New Cumberland, PA (US); Timothy Wickard, Carlisle, PA (US)

(73) Assignee: Souriau USA, Inc., York, PA (US)

( * ) Notice: Subject to any disclaimer, the term of this patent is extended or adjusted under 35 U.S.C. 154(b) by 0 days.

(21) Appl. No.: 12/904,652

(22) Filed: Oct. 14, 2010

(51) Int. Cl.
*H01R 13/60* (2006.01)

(52) U.S. Cl. ..... 439/535

(58) Field of Classification Search ..... 439/535, 439/552, 210, 76.1, 211, 135; 174/53; 361/643
See application file for complete search history.

(56) References Cited

U.S. PATENT DOCUMENTS

| | | | | |
|---|---|---|---|---|
| 4,737,119 | A | 4/1988 | Stieler | |
| 4,900,068 | A | 2/1990 | Law | |
| 5,072,072 | A | 12/1991 | Bawa et al. | |
| 5,266,050 | A * | 11/1993 | O'Neil et al. | 439/552 |
| 5,662,488 | A | 9/1997 | Alden | |
| 5,857,865 | A | 1/1999 | Shimirak et al. | |
| 6,056,599 | A | 5/2000 | Flickinger et al. | |
| 6,540,549 | B2 * | 4/2003 | Rupert | 439/502 |
| 6,642,451 | B1 | 11/2003 | Gretz | |
| 6,935,890 | B1 * | 8/2005 | Gretz | 439/552 |
| 7,278,878 | B2 * | 10/2007 | Draggie et al. | 439/535 |
| 7,618,284 | B2 * | 11/2009 | Lamoureux et al. | 439/535 |
| 7,697,268 | B2 * | 4/2010 | Johnson et al. | 361/643 |
| 7,727,031 | B2 * | 6/2010 | Lord | 439/680 |
| 7,736,175 | B1 * | 6/2010 | Savicki et al. | 439/535 |
| 7,851,704 | B2 * | 12/2010 | Fitch et al. | 174/53 |
| 2009/0053926 | A1 * | 2/2009 | Johnson et al. | 439/535 |

OTHER PUBLICATIONS

Souriau Connection Technology UTS Catalog, www.souriau.com, 2006 pp. 63-66.

* cited by examiner

*Primary Examiner* — Chandrika Prasad
(74) *Attorney, Agent, or Firm* — McNees Wallace & Nurick LLC

(57) ABSTRACT

A versatile modular connector and a conduit system which is easily used and installed by electricians and non-electricians in the field are described. The components, such as the junction box, outlet boxes and bridge cables can be prewired and easily added to the system by using the quick connect connectors to allow for a stable and sealed system.

20 Claims, 7 Drawing Sheets

ELECTRICAL CONNECTOR WITH ONE END THREADABLY CONNECTED TO A JUNCTION BOX AND OTHER END CONFIGURED TO BE CONNECTED TO A MATING ELECTRICAL CONNECTOR

FIELD OF THE INVENTION

The present invention is directed to a connector which is attached to a conduit or the like and which provides for a sealed and secured connection to a mating connector and which allows for the quick mating and disconnection of the mating connector.

BACKGROUND OF THE INVENTION

Currently, the termination of individual cables to junction boxes and outlet boxes requires the use of an electrician or skilled personnel. The cables are generally fed into the boxes, stripped and terminated using standard termination techniques. This technique is used when terminating a power line or when providing a connection between boxes. This process is labor intensive, particularly in harsh environments in which the boxes must be sealed against moisture and the like. Such sealed connection often requires multi-piece devices in which a portion must be dismantled to provide proper connection and sealing when reassembled.

For example, U.S. Pat. No. 4,900,068 to Law discloses a sealed connector that accepts a non-metallic conduit that is grasped by fingers on a clip grasping above an annular ring on a ferrule. To fit the conduit into the sealed connector, the installer must insert the conduit into the fitting, and then tighten a compression nut with a hand tool such as a wrench to close the fingers on the clip and thereby achieve a sealed fit. The leading end of the fitting is threaded and must be inserted into the knock-out of a panel or box, a nut is screwed onto the threaded end, and then a hand tool is typically used to secure the fitting to the panel or box. A hand tool therefore is typically employed to achieve a secure sealed connection on both the trailing end of the fitting, between the conduit and the fitting, and on the leading end of the fitting, between the fitting and the panel or box.

U.S. Pat. No. 5,072,072 discloses a fitting that requires minimal torque on a gland nut to secure the conduit to the trailing end of the fitting. The gland nut must be removed from the connector body and then is inserted over an electrical conduit with the outer surface of the conduit being received through the centrally located bore of the gland nut. The conduit is then pushed onto a ferrule. Upon tightening of the gland nut on the connector body, the gland nut engages resilient fingers with minimal friction loss, thereby enhancing hand tightening or minimizing the torque required with a tightening tool. The leading end of the fitting is typically threaded and requires the use of a nut and an O-ring to secure the fitting to the panel and achieve a sealed connection.

While these and other known connectors allow for providing a sealed connection between the conduit and the panels, these known connectors illustrate the difficulty of terminating the cable to the boxes, particularly in environments in which sealing is required. It would, therefore, be beneficial to provide for an electrical system which is preassembled and modular and which uses connectors attached to the cables and the boxes which allow for a quick, simple connection and which provide both sealing and stability in harsh environments.

While a number of quick connect connectors are known, these connectors are not used to provide a modular distribution system. One such connector is disclosed in U.S. Pat. No. 4,737,119. A circular connector is described for a plug-type connection to a mating connector which uses complementary locking means that are engaged and disengaged by rotation. Helical locking grooves are provided which have a bayonet detent space extending in an axial direction and an adjacent detent space extending in the peripheral direction. The detent space is defined by limiting means. Complementary noses on the mating connector are movable by rotation along the grooves into the detent spaces to lock the connectors.

However, although sealed connectors and locking connectors are known in the prior art, it would be beneficial to provide a system of connecting cable and conduit in a manner which allows for the system to be modular. In so doing, it would be beneficial to have a sealed and secure system in which the conduit is terminated to connectors which can be connected to mating connectors using quick connect and disconnect technology, thereby allowing the modular system to be customized in the field without the need for electricians.

SUMMARY OF THE INVENTION

A versatile modular connector and a conduit system which is easily used and installed by electricians and non-electricians in the field are described. The components, such as the junction box, outlet boxes and bridge cables can be prewired and easily added to the system by using the quick connect connectors to allow for a stable and sealed system.

One aspect of the invention is directed to a pluggable, preassembled electrical system which has an electrical connector and a junction box. The electrical connector has a housing with a first end and a second end. The first end has projections for cooperating with a mating connector, and the second end has threads which extend about an outside surface of the housing. The junction box has openings which extend through a surface thereof. The openings have mating threads which are provided about an inner circumference thereof. The electrical connector is mounted and maintained in the junction box by the cooperation of the threads with the mating threads, such that the electrical connector is mounted and terminated in the junction box prior to shipping, thereby allowing the junction box with the electrical connector mounted therein to be field-installed and mated with the mating connector without the need for electrical expertise or tools.

The electrical system may also include an outlet box which is electrically connected to a bridge cable. The bridge cable has the mating connector terminated thereon. The mating connector has recesses which are adapted to receive the projections of the electrical connector therein to place the mating connector in electrical engagement with the electrical connector. The outlet box may have outlet openings which extend through a surface thereof, and which have outlet mating threads which are provided about an inner circumference thereof. A second electrical connector has a housing having a first end and a second end. Projections of the first end cooperate with a second mating connector. The second end has threads which extend about an outside surface of the housing. The second electrical connector may be mounted and maintained in the outlet box by the cooperation of the threads of the second electrical connector with the outlet mating threads. The second electrical connector is mounted and terminated in the outlet box prior to shipping, thereby allowing the outlet box with the second electrical connector mounted therein to be field-installed and mated with the second mating connector without the need for electrical expertise or tools.

Another aspect of the invention is directed to a sealed, preassembled electrical system. An electrical connector of the system has a housing with a first end and a second end, the first end having projections for cooperating with a mating connector and the second end having threads which extend about an outside surface of the housing. A first seal is provided proximate the first end. The first seal cooperates with the mating connector to provide a sealed interconnection between the electrical connector and the mating connector when in the mated position. A junction box having openings which extend through a surface thereof is also provided in the system. The openings having mating threads which are provided about an inner circumference thereof. A second seal is provided between the electrical connector and the junction box, the electrical connector being mounted and maintained in the junction box by the cooperation of the threads with the mating threads, the second seal cooperating with the junction box and the electrical connector to provide a seal therebetween. The electrical connector is mounted, terminated and sealed in the junction box prior to shipping, thereby allowing the junction box with the electrical connector mounted therein to be field-installed in harsh environments and mated with the mating connector without the need for electrical expertise or tools.

Another aspect of the invention is directed to an electrical connector for use in a preassembled electrical system. The electrical connector has a housing with a first end and a second end. The first end has projections for cooperating with a mating connector, and the second end has threads which extend about an outside surface of the housing. The threads cooperate with threaded openings of a junction box. The electrical connector is mounted and maintained in the junction box by the cooperation of the threads with the mating threads, such that the electrical connector is mounted and terminated in the junction box prior to shipping, thereby allowing the junction box with the electrical connector mounted therein to be field-installed and mated with the mating connector without the need for electrical expertise or tools.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
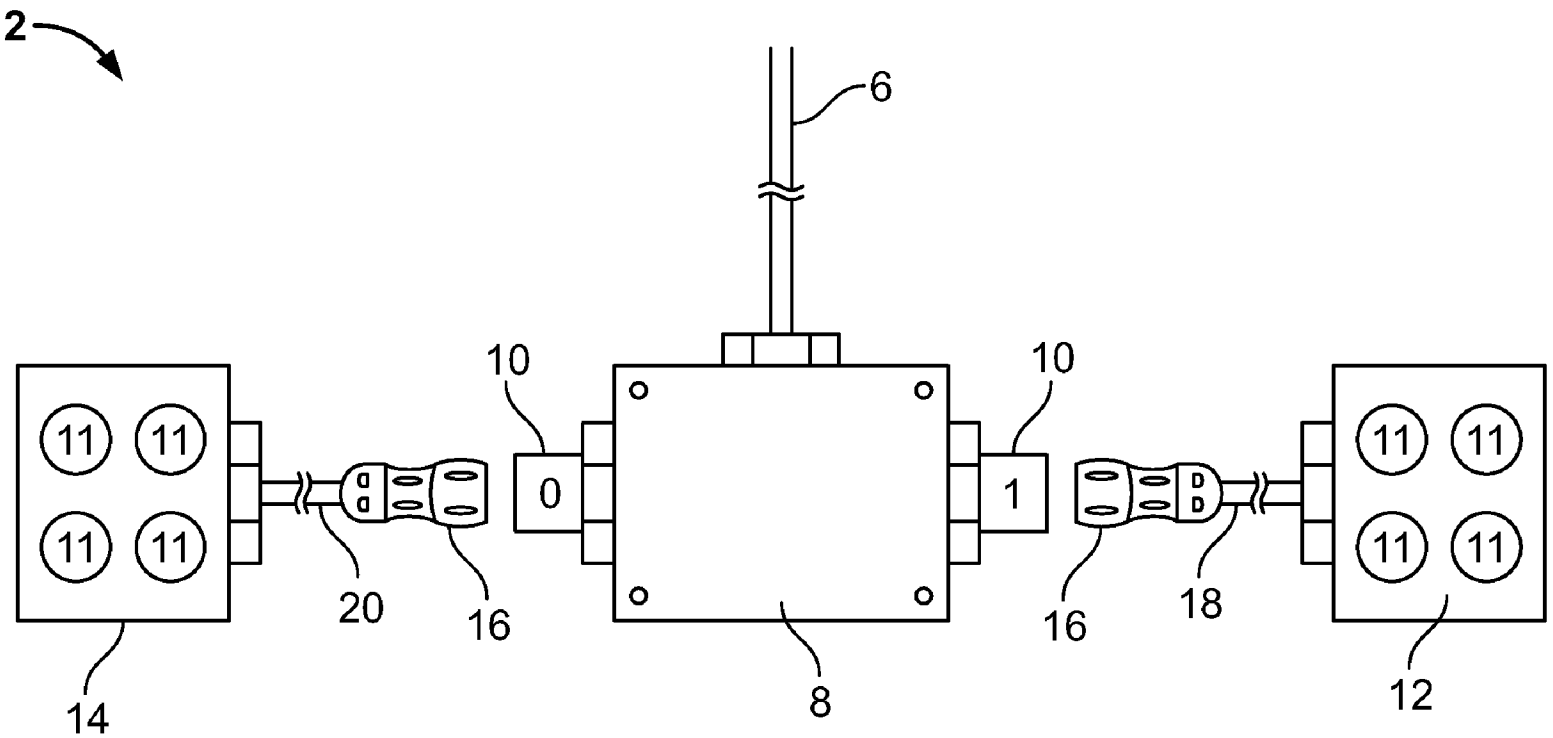
FIG. 1 is a plan view of one embodiment of the modular system of the present invention showing exemplary power boxes securely connected to an exemplary junction box through the use of sealed, quick connect connectors.
Figure 2:
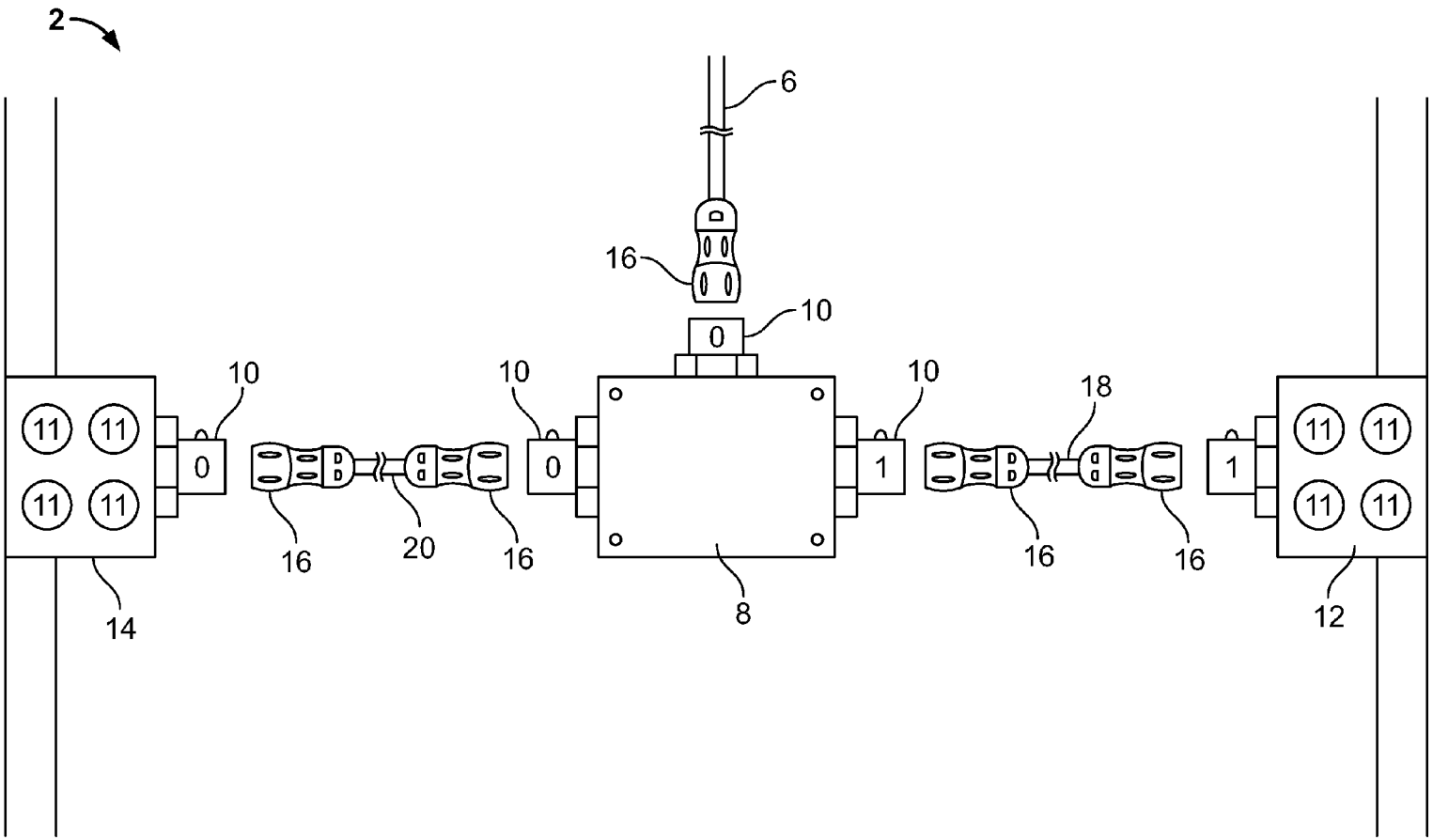
FIG. 2 is a plan view of an alternate embodiment of the modular system of the present invention showing exemplary power boxes securely connected to an exemplary junction box through the use of sealed, quick connect connectors and showing the power supply securely connected to the exemplary junction box through the use of sealed, quick connect connectors.
Figure 3:
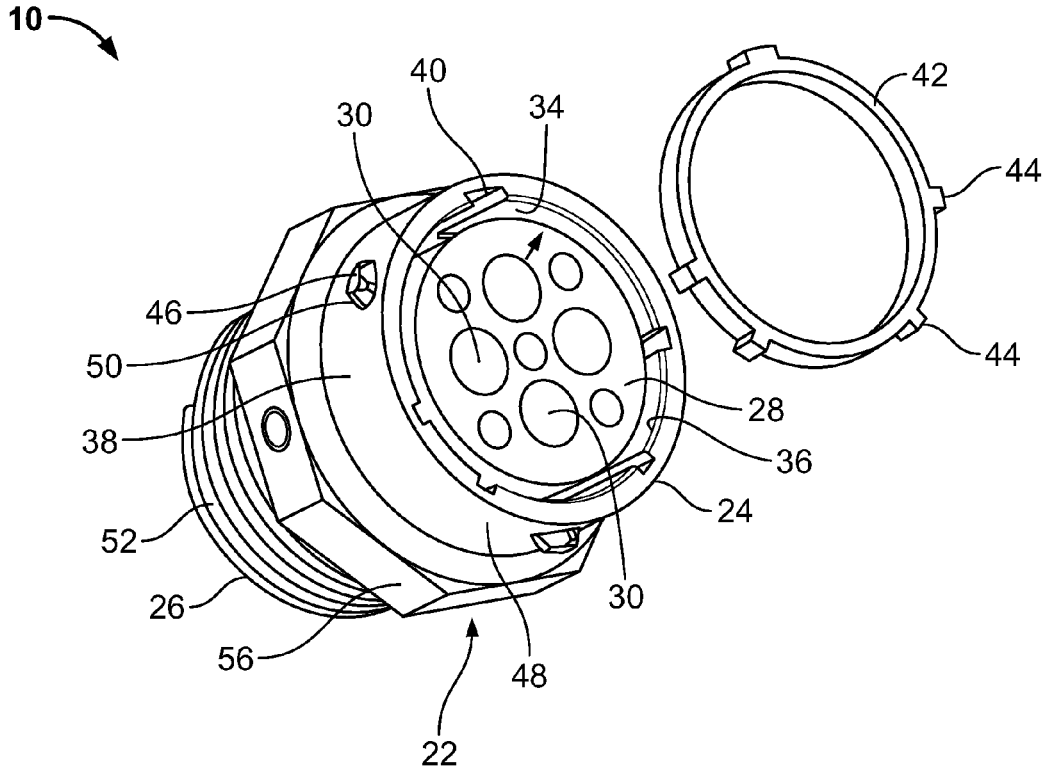
FIG. 3 is a perspective view of one embodiment of the first connector prior to termination to a conduit.
Figure 4:
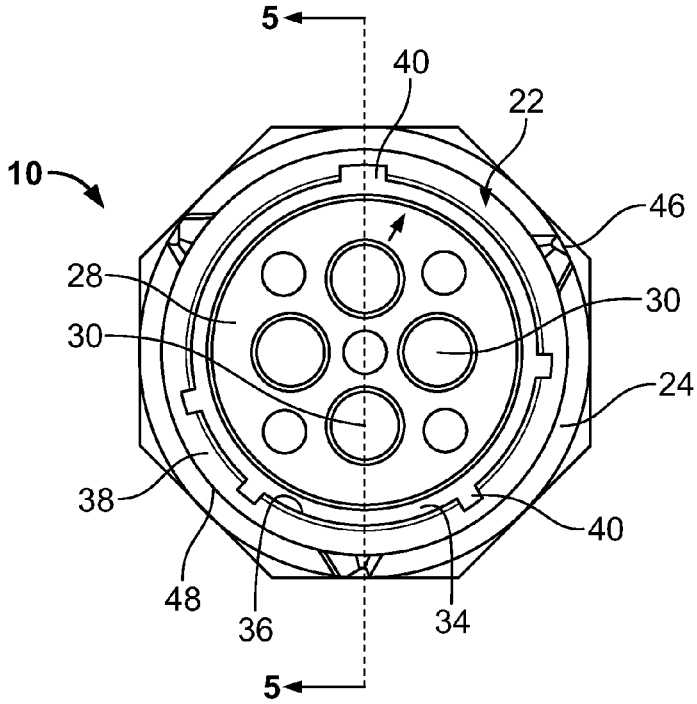
FIG. 4 is a front view of the first connector of FIG. 3.
Figure 5:
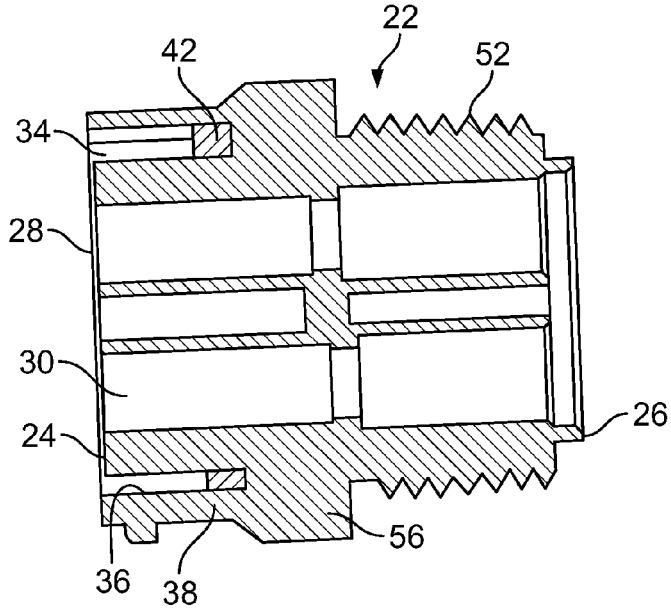
FIG. 5 is a cross-sectional view of the first connector taken along line 5-5 of FIG. 4.

Referring to FIGS. 1 and 2, a modular, pluggable system 2 is shown for delivering electrical power to various locations within a room or space. The systems shown in FIGS. 1 and 2 are exemplary and are not meant to limit the scope of the invention to only those embodiments shown. Other configurations and other components may be used without departing from the scope of the invention.

Referring to FIG. 1, one embodiment of the pluggable system 2 is shown. A power cable 6 is inserted and terminated within a junction box 8. The power cable 6 is terminated to two connectors 10 using known termination methods. While two connectors 10 are shown, the number of connectors which are terminated to the power cable 6 and housed in the junction box 8 may vary depending upon the particular application. Respective outlet boxes 12, 14 are electrically connected to the junction box 8 by mating respective connectors 10 with respective mating connectors 16. Bridge cables 18 extend between the mating connectors 16 and the outlet boxes 12, 14. Detailed descriptions of the connectors 10 and the mating connectors 16 are provided below.

Referring to FIG. 2, a second embodiment of the pluggable system 2 is shown. In this embodiment, the power cable 6 is terminated to a mating connector 16. The mating connector 16 is provided in electrical connection with a respective connector 10 mounted in the junction box 8. The junction box 8 has two additional connectors 10 which are positioned in a similar manner to the connectors shown in FIG. 1. While two additional connectors 10 are shown, the number of connectors which are mounted in the junction box 8 may vary depending upon the particular application. Respective outlet boxes 12, 14 are electrically connected to the junction box 8 by bridge cables 18, 20. In this embodiment, each bridge cable 18, 20 has a mating connector 16 terminated to either end of the bridge cable 18, 20. One mating connector 16 of the bridge cable 18, 20 is provided in electrical connection with a respective connector 10 of the junction box 8, while the other mating connector 16 is provided in electrical connection with a connector 10 mounted in a respective outlet box 12, 14.

All of the mating connectors 16 have similar features. However, in order to prevent the power cable 6 or respective bridge cables 18, 20 from being improperly terminated in a wrong location, each or select mating connectors 10 may be provided with discrete keying to prevent the termination of the respective mating connector 16 and the respective power cord 6 or bridge cables 18, 20 to an improper connector 10 or improper location. Similarly, each or select connectors 10 may also be provided with discrete keying to prevent the termination of the respective connectors 10 and the respective junction box 8 or outlet boxes 12, 14 to an improper mating connector 16.

In the embodiments shown, the connectors 10 are female receptacle connectors and the mating connectors 16 are male plug connectors. However, the connector 10 may be a male connector and the mating connector 16 may be a female connector without departing from the scope of the invention.

Referring to FIGS. 3-7, each connector 10 has a generally cylindrical housing 22 with a first end 24 and a second end 26.

Figure 6:
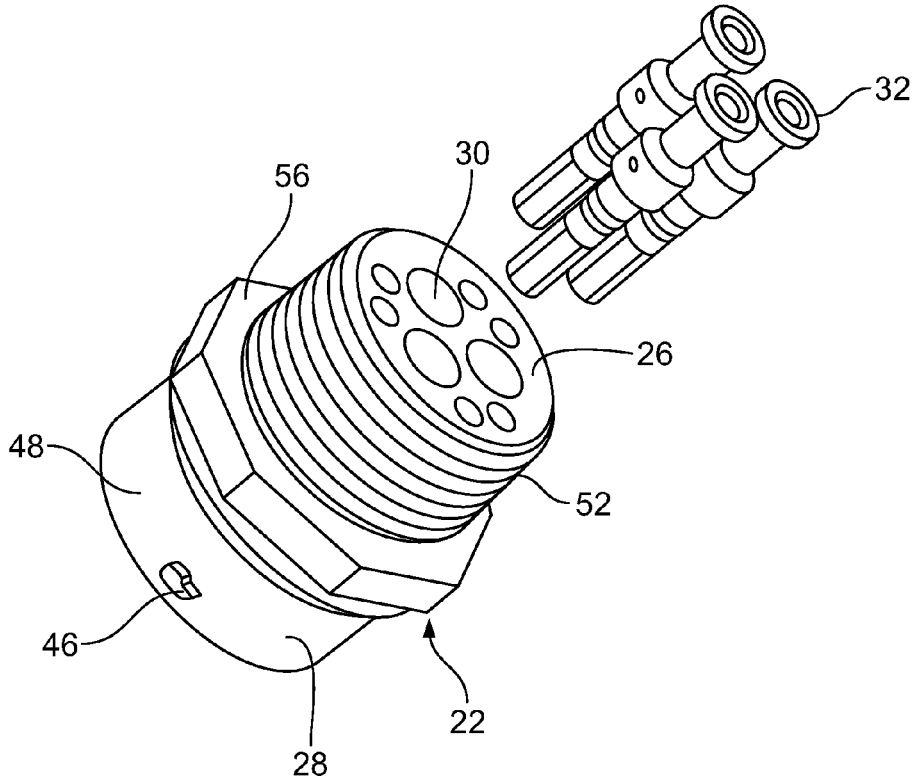
FIG. 6 is a perspective view of an alternate embodiment of the first connector, with the terminals exploded therefrom.
Figure 7:
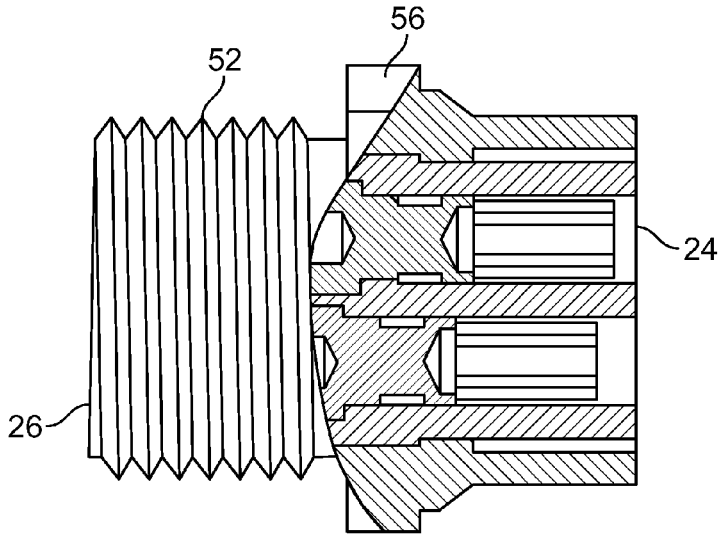
FIG. 7 is a cross-sectional view of the connector of FIG. 6 with the terminals properly inserted therein.

A terminal receiving portion 28 extends from proximate the first end 24 toward the second end 26. Contact receiving cavities 30 are provided in the terminal receiving portion 28, the contact receiving cavities 30 configured to receive and retain contacts or terminals 32 therein (FIGS. 6 and 7). A recess 34 extends from the first end 24 about the circumference of the terminal receiving portion 28 and is positioned between the terminal receiving portion 28 and an interior surface 36 of an exterior wall 38 of the connector 10. Keying slots 40 extend from the recess 34 into the interior surface 36 of the exterior wall 38. A circular peripheral seal 42 (FIG. 5) is positioned in the recess 34. The circular seal 42 has projections 44 which cooperate with the keying slots 40 to properly position and maintain the peripheral seal 42 in the recess 34. Engagement projections or bosses 46 are spaced periodically about the outside surface 48 of the exterior wall 38. The engagement bosses 46 are generally spaced an equal distance from the first end 24 of the connector 10. The configuration of the engagement bosses 46 may vary, but each engagement boss 46 has a rounded or sloped surface 50 which facilitates the insertion of the engagement bosses 46 into the engagement recesses 93 of the plug housing 66 of the mating connector 16, as will be more fully described.

Threads 52 are provided on an outside surface of the housing proximate the second end 26 of the connector 10. The threads 52 are large threads of the type usually used in electrical, plumbing and other similar applications.

The contact receiving cavities 30 extend through the second end 26. The terminals 32 are terminated to individual conductors of a cable (not shown) or other electrically conductive members (not shown) which are housed in either junction box 8 or outlet boxes 12, 14 and which enter through the second end 26 of the connector 10. The method of termination of the conductors to the terminals 32 is well known in the art and, therefore, a detailed description will not be provided.

Figure 8:
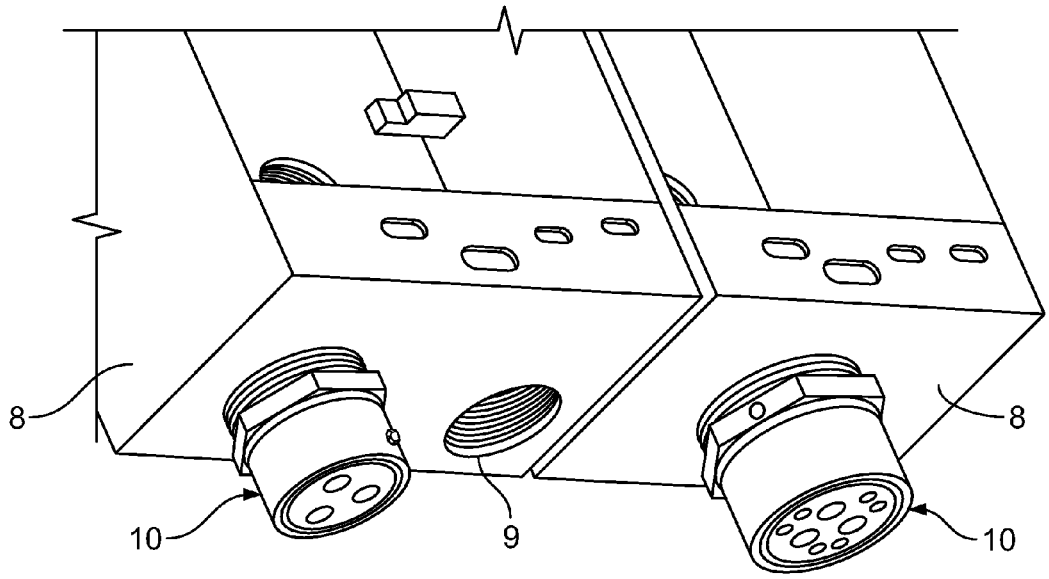
FIG. 8 is a perspective view of two exemplary boxes to which first electrical connectors are attached.

As best shown in FIG. 8, a mounting projection or surface 56 is provided on the connector 10 between the threads 52 and the engagement bosses 46. The mounting projection 56 will cooperate with an external surface of the junction box 8 to keep the engagement bosses 46 outside of the external surface.

Figure 9:
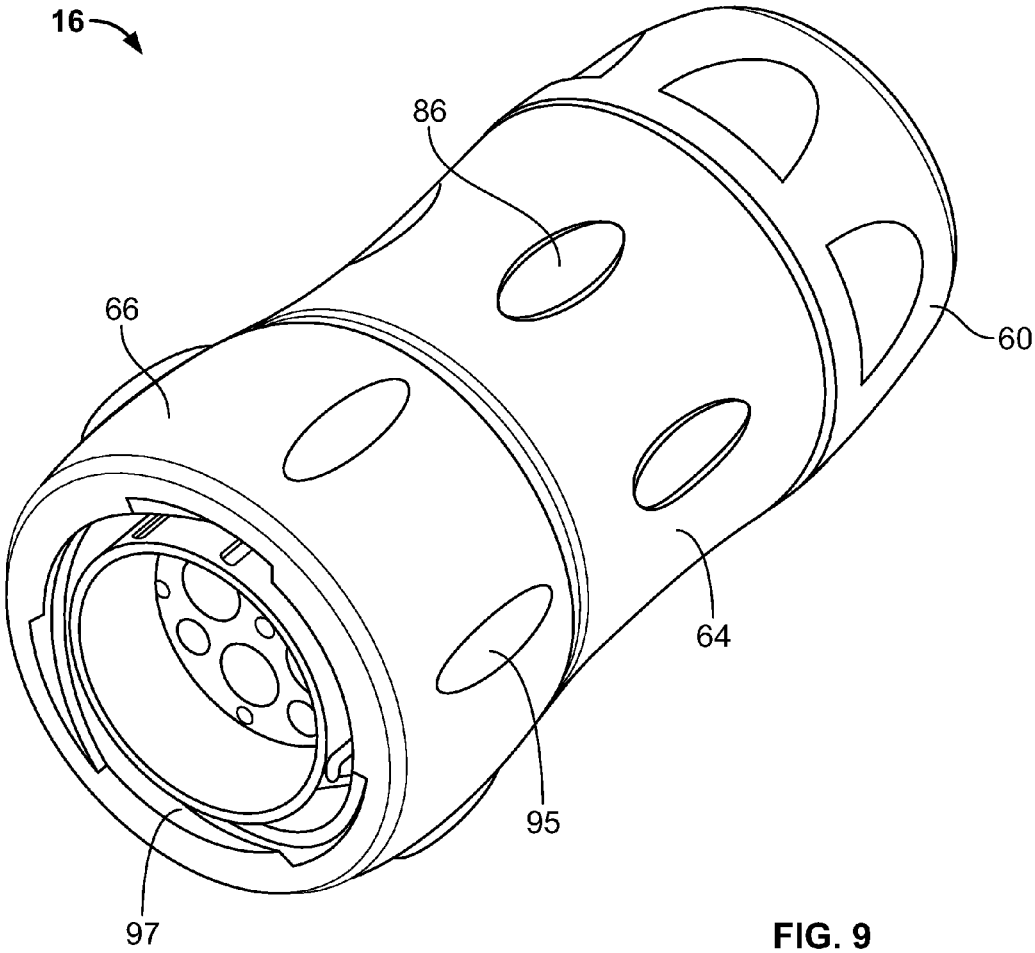
FIG. 9 is a perspective view of one embodiment of the second connector prior to mating with the first connector, the second connector is shown with no contact inserted therein.
Figure 10:
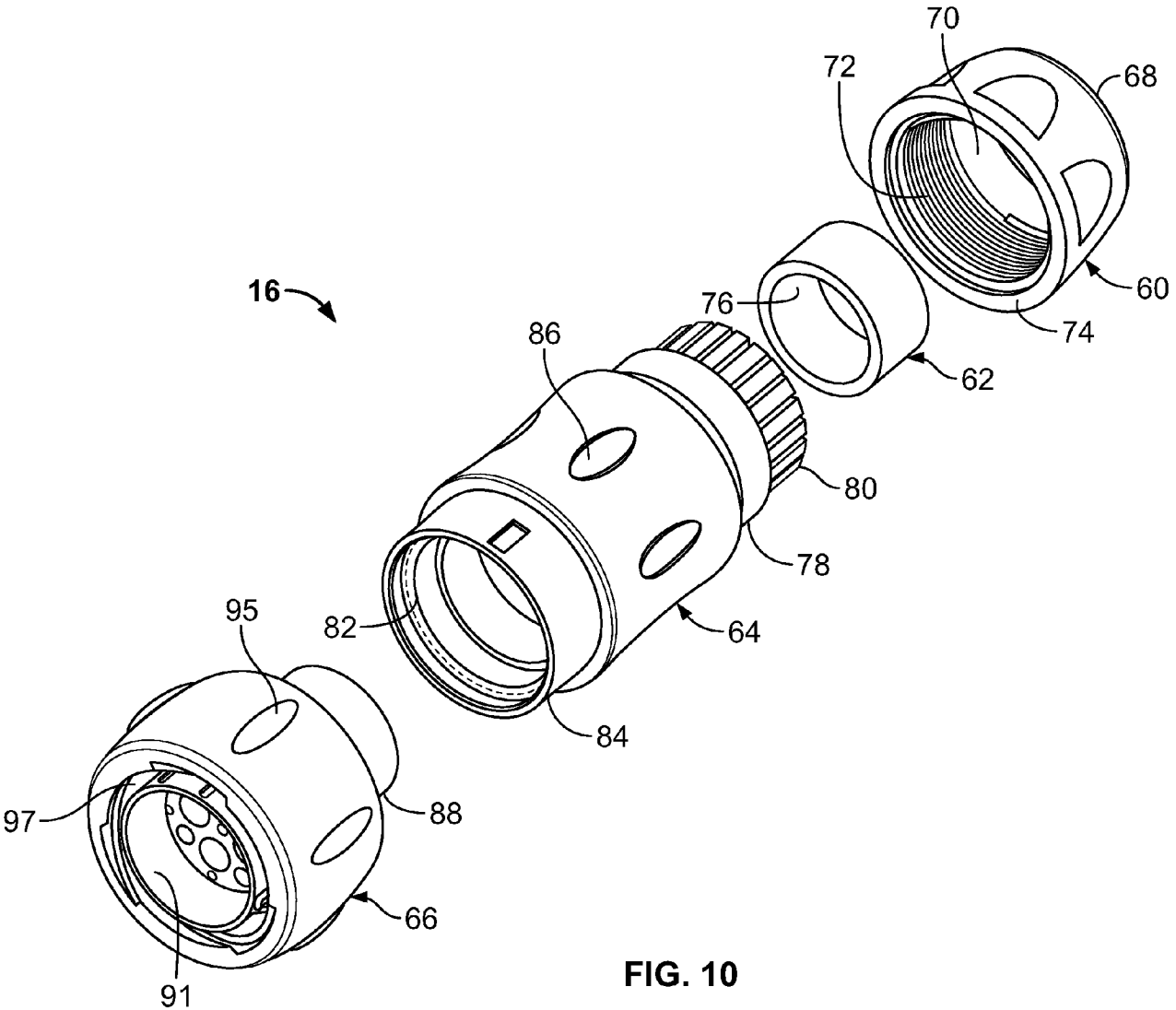
FIG. 10 is an exploded perspective view of the second connector of FIG. 9.

As best shown in FIGS. 9 and 10, the mating connector 16 has a protective back shell 60 a sealing member 62, a protective front shell 64 and a plug housing 66. In the embodiment shown, the mating connector 16 is a UTS Plug manufactured and sold by Souriau Connection Technology under the trademark TRIM TRIO. However, the invention is not limited to this type of male connector, and other types of male connectors can be substituted without departing from the scope of the invention.

The back shell 60 is made from nonconductive material which has the strength characteristics required. The back shell 60 has a generally cylindrical configuration. A back surface 68 of the back shell 60 has an opening 70 which is dimensioned to accept the cable (not shown) therethrough. The back shell 60 has threads 72 positioned about the circumference of an inner surface. The threads 72 extend from a front surface 74 toward the back surface 68 of the back shell 60.

The sealing member 62 has a cylindrical shape which is dimensioned to be received in the back shell 60. The sealing member 62 has an opening 76 that is dimensioned to receive the cable therethrough. The sealing member 62 is made of elastomer, rubber or other material which has the compliant and moisture-resistant properties necessary. Additional sealing may be provided by the molded back shell 60.

The front shell 64 is generally cylindrical in configuration, and has an outside surface with a diameter that is varied along its length. However, other configurations of the outside surface are anticipated. An inside surface of the front shell 64 has a basically uniform diameter to allow for the insertion of the cable therein. The front shell 64 has outward facing threads 78 provided on the outside surface proximate a back end 80 thereof. The outward facing threads 78 cooperate with the threads 72 of the back shell 60 when the front shell 64 and back shell 60 are mated together. Inward facing threads 82 are provided proximate the front end 84 of the inside surface of the front shell 64. The front shell 64 may have a plurality of grooves 86 formed about the outside surface thereof, allowing the front shell 64 to be properly gripped by the user.

The plug housing 66 has threads 88 which extend from a first end 90. The threads 88 are adapted to engage with the threads 82 of the front shell 64. An insulating member 91 is molded in or positioned in the plug housing 66. The insulating member 91 has a plurality of terminal pins (not shown) mounted therein. The terminal pins are connected by conventional means (such as crimping) to corresponding electrical wires bundled within the cable.

The plug housing 66 has a plurality of engagement recesses 93 formed about an interior surface of an exterior wall of a second end 94. The engagement recesses 93 are generally adapted to receive axial engagement of the engagement bosses 46 of the connector, and to thereafter retain the engagement bosses 46 in a known manner. The plug housing 66 has a plurality of grooves 95 formed about the exterior surface thereof, allowing the plug housing 66 to be properly gripped by the user.

The second end 94 of the plug housing 66 has an interior cylindrical wall 96 which extends about the circumference of the insulating member 91. The interior wall 96 is spaced from the exterior wall, thereby providing a recess 97 therebetween. Keying projections (not shown) extend periodically from the interior wall 96 toward the exterior wall. The keying projects have a longitudinal axis which is essentially parallel to the longitudinal axis of the front shell 64. The positioning and spacing of the keying projections corresponds to the keying slots 40 provided in the connector 10. This insures that the mating connector 16 and connector 10 can only be mated in an orientation to allow for proper electrical connection across the terminals 32, 92.

The plug housing 66 may include a visual indicator or marking (not shown) on the exterior surface of the plug housing 66, which may be aligned with a corresponding visual indicator (not shown) on the connector 10 to provide easy and proper alignment of the mating connector 16 and the connector 10.

With the terminal pins properly connected to the individual conductors of the cable, the plug housing 66, front shell 64, sealing member 62 and back shell 60 are assembled according to well-known methods.

As previously described, each connector 10 is placed in physical and electrical connection with a conduit or power source in the junction box 8 or outlet box 12, 14. Each connector 10 is positioned and maintained in a respective opening 9 of the junction box 8. FIG. 8 shows connector 10 oriented and aligned with a junction box 8. Typically, each connector 10 is installed to a threaded access hole 9 by screwing the connector 10 with the external threads 52 proximate the second end 26. Alternatively, a snap ring, such as that disclosed in U.S. Pat. No. 6,935,890, and incorporated herein by reference, can be used. In such case, the user could install the connector in a knock-out hole (not shown). In another alternative, a nut (not shown) may be inserted over the second end 26 and onto the threads 52. The nut is tightened to capture a wall of junction box 8 or outlet box 12, 14 between the mounting projection 56 and the nut, thereby securing and maintaining the connector 10 in position on the junction box 8 or outlet box 12, 14. In all cases, a seal or sealing ring 99 may be used to achieve a sealed connection between the connector 10 and the box 8 or outlet box 12, 14. With the connector 10 secured, the engagement bosses 46 extend from the junction box 8 or outlet box 12, 14 for mating with the mating connector 16.

The use of the type of connector 10 described can be of benefit in applications in which the conduit is installed in structures, including modular structures, which are used in harsh environments and which are assembled and then shipped to the site. The connector 10 can be installed onto the conduit at the factory and shipped. The completed system arrives on site ready to have the second connector mated thereto, thereby eliminating the need for an electrician.

With the connector 10 properly mounted in the junction box 8 or outlet box 12, 14, the assembled mating connector 16 is brought into engagement with the connector 10. In so doing, if appropriate, the visual indicators on the connector 10 and mating connector 16 are aligned and the mating connector 16 is inserted onto the connector 10. As this occurs, the keying projections align with and are slid into the keying slots 40 in the connector 10. If no visual indicators are provided, the mating connector 16 is rotated until the keying projections align with the keying slots 40. When the projections and slots 40 are aligned, the terminals of the mating connector 16 and the terminals 32 of the connector 10 are properly aligned.

Use of keying slots 40 and of keying projections also provides preliminary alignment of the engagement bosses 46 of the connector 10 with the engagement recesses 93 of the mating connector 16. As previously stated, variations in the keying configuration can also be used to provide positive lock-out differentiation between differing internal circuit configurations.

Continued axial engagement of the connectors 10, 16 causes the engagement bosses 46 to be moved into the engagement recesses 93. The plug housing 66 is then rotated, causing the engagement recesses 93 to move relative to the engagement bosses 46. Rotation of the plug housing 66 is stopped by the engagement bosses 46 engaging an end wall of the engagement recesses 93. The engagement bosses 46 and engagement recesses 93 may be configured to provide for continued rotational resistance of the plug housing 66, thereby providing assurance against any incidental rotation (and possible unlocking of the connector assembly) due to outside influences such as shock or vibration in the connector environment.

To disengage the connectors 10, 16, an applied rotational force must be exerted on the plug housing 66 (by manually rotating the plug housing 66) to move the plug housing 66, causing the engagement recesses 93 to move relative to the engagement bosses 46.

The invention described herein defines a versatile modular connector and conduit system which is easily used and installed by electricians and non-electricians. The components, such as the junction box 8, outlet boxes 12, 14 and bridge cables 18, 20 can be prewired and easily added to the system by using the quick connect connectors to allow for a stable and sealed system.

The foregoing description is intended primarily for purposes of illustration. While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A pluggable, preassembled electrical system comprising:

an electrical connector comprising:

a housing having a first end and a second end, the first end having projections for cooperating with a mating connector, the second end having threads which extend about an outside surface of the housing;

a junction box having openings which extend through a surface thereof, the openings having mating threads which are provided about an inner circumference thereof;

the electrical connector being mounted and maintained in the junction box by the cooperation of the threads with the mating threads;

whereby the electrical connector is mounted and terminated in the junction box prior to shipping, thereby allowing the junction box with the electrical connector mounted therein to be field-installed and mated with the mating connector without the need for electrical expertise or tools.

2. The pluggable, preassembled electrical system as recited in claim 1, further comprising:

an outlet box electrically connected to a bridge cable or conduit, the bridge cable or conduit having the mating connector terminated thereon, the mating connector having recesses which are adapted to receive the projections of the electrical connector therein to place the mating connector in electrical engagement with the electrical connector.

3. The pluggable, preassembled electrical system as recited in claim 2, further comprising:

the outlet box having outlet openings which extend through a surface thereof, the outlet openings having outlet mating threads which are provided about an inner circumference thereof;

a second electrical connector comprising:

a housing having a first end and a second end, the first end having projections for cooperating with a second mating connector, the second end having threads which extend about an outside surface of the housing;

the second electrical connector being mounted and maintained in the outlet box by the cooperation of the threads of the second electrical connector with the outlet mating threads;

whereby the second electrical connector is mounted and terminated in the outlet box prior to shipping, thereby allowing the outlet box with the second electrical connector mounted therein to be field-installed and mated with the second mating connector without the need for electrical expertise or tools.

4. The pluggable, preassembled electrical system as recited in claim 3, further comprising:

the bridge cable or conduit having the second mating connector terminated thereon, the second mating connector having recesses which are adapted to receive the projections of the second electrical connector therein to place the second mating connector in electrical engagement with the second electrical connector.

5. The pluggable, preassembled electrical system as recited in claim 1, wherein the electrical connector and the mating connector have discrete keying to prevent the termination of the electrical connector or the mating connector to the second electrical connector or the second mating connector.

6. The pluggable, preassembled electrical system as recited in claim 1, wherein a seal is provided between the electrical connector and the junction box to achieve a sealed connection therebetween.

7. The pluggable, preassembled electrical system as recited in claim 6, wherein a second seal is provided between the second electrical connector and the outlet box to achieve a sealed connection therebetween.

8. A sealed, preassembled electrical system comprising:

an electrical connector comprising:

a housing having a first end and a second end, the first end having projections for cooperating with a mating connector, the second end having threads which extend about an outside surface of the housing, a first seal being provided proximate the first end, the first seal cooperating with the mating connector to provide a sealed interconnection between the electrical connector and the mating connector when in the mated position;

a junction box having openings which extend through a surface thereof, the openings having mating threads which are provided about an inner circumference thereof;

a second seal provided between the electrical connector and the junction box, the electrical connector being mounted and maintained in the junction box by the cooperation of the threads with the mating threads, the second seal cooperating with the junction box and the electrical connector to provide a sealed connection therebetween;

whereby the electrical connector is mounted, terminated and sealed in the junction box prior to shipping, thereby allowing the junction box with the electrical connector mounted therein to be field-installed in harsh environments and mated with the mating connector without the need for electrical expertise or tools.

9. The sealed, preassembled electrical system as recited in claim 8, further comprising:

an outlet box electrically connected to a bridge cable or conduit, the bridge cable or conduit having the mating connector terminated thereon, the mating connector having recesses which are adapted to receive the projections of the electrical connector therein to place the mating connector in electrical engagement with the electrical connector.

10. The sealed, preassembled electrical system as recited in claim 9, further comprising:

the outlet box having outlet openings which extend through a surface thereof, the outlet openings having outlet mating threads which are provided about an inner circumference thereof;

a second electrical connector comprising:

a housing having a first end and a second end, the first end having projections for cooperating with a second mating connector, the second end having threads which extend about an outside surface of the housing, a second seal being provided proximate the first end, the second seal cooperating with the second mating connector to provide a sealed interconnection between the second electrical connector and the second mating connector when in the mated position;

the second electrical connector being mounted and maintained in the outlet box by the cooperation of the threads of the second electrical connector with the outlet mating threads;

whereby the second electrical connector is mounted, terminated and sealed in the outlet box prior to shipping, thereby allowing the outlet box with the second electrical connector mounted therein to be field-installed in harsh environments and mated with the second mating connector without the need for electrical expertise or tools.

11. The sealed, preassembled electrical system as recited in claim 10, further comprising:

the bridge cable or conduit having the second mating connector terminated thereon, the second mating connector having recesses which are adapted to receive the projections of the second electrical connector therein to place the second mating connector in electrical engagement with the second electrical connector.

12. The sealed, preassembled electrical system as recited in claim 8, wherein the electrical connector and the mating connector have discrete keying to prevent the termination of the electrical connector or the mating connector to the second electrical connector or the second mating connector.

13. The sealed, preassembled electrical system as recited in claim 12, wherein the second electrical connector and the second mating connector have second discrete keying to prevent the termination of the second electrical connector or the second mating connector to the electrical connector or the mating connector.

14. An electrical connector for use in a preassembled electrical system, the electrical connector comprising:

a housing with a first end and a second end, the first end having projections for cooperating with a mating connector, the second end having threads which extend about an outside surface of the housing, the threads cooperating with threaded openings of a junction box;

whereby the electrical connector is mounted and maintained in the junction box by the cooperation of the threads with the mating threads, thereby allowing the junction box with the electrical connector mounted therein to be field-installed and mated with the mating connector without the need for electrical expertise or tools.

15. The electrical connector as recited in claim 14, wherein the electrical connector has discrete keying to prevent the termination of the electrical connector to an improper mating.

16. The electrical connector as recited in claim 15, wherein a first seal is provided proximate the first end of the housing, the first seal cooperating with the mating connector to provide a sealed interconnection between the electrical connector and the mating connector when in the mated position.

17. The electrical connector as recited in claim 16, wherein a second seal is provided proximate the second end of the housing, the second seal cooperating with the junction box to provide a sealed interconnection between the junction box and the electrical connector when the electrical connector is mated to the junction box.

18. The electrical connector as recited in claim 16, wherein a terminal receiving portion extends from proximate the first end toward the second end, contact receiving cavities are provided in the terminal receiving portion and are configured to receive and retain terminals therein, a recess extends from the first end about the circumference of the terminal receiving portion and is positioned between the terminal receiving portion and an interior surface of an exterior wall of the electrical connector, keying slots extend from the recess into the interior surface of the exterior wall, the first seal is positioned in the recess and has projections which cooperate with the keying slots to properly position and maintain the first seal in the recess.

19. The electrical connector as recited in claim 18, wherein engagement projections are spaced periodically about the outside surface of the exterior wall, the engagement bosses cooperating with the mating connector to maintain the electrical connector and mating connector in a mated position.

20. The electrical connector as recited in claim 18, wherein a mounting projection is provided on the electrical connector between the threads and the engagement bosses, the mounting projection 56 cooperating with an external surface of the junction box to keep the engagement bosses outside of the external surface.

* * * * *